US005105343A

United States Patent [19]

Wakimoto

[11] Patent Number: 5,105,343

[45] Date of Patent: Apr. 14, 1992

[54] DECORATIVE TORCH WITH ILLUMINATED GRIP PORTION

[76] Inventor: Yasuo Wakimoto, 3-6, Nishiasakusa 1-chome, Taito-to, Tokyo, Japan

[21] Appl. No.: 687,969

[22] Filed: Apr. 19, 1991

[30] Foreign Application Priority Data

Nov. 14, 1990 [JP] Japan ..... 2-307592

[51] Int. Cl.[5] ..... F21L 7/0; F21V 8/0

[52] U.S. Cl. ..... 362/101; 362/202; 362/806; 362/809; 362/277

[58] Field of Search ..... 362/101, 102, 202, 187, 362/188, 32, 806, 808, 809, 277

[56] References Cited

U.S. PATENT DOCUMENTS

| | | | |
|---|---|---|---|
| 2,29,443 | 10/1941 | Geier | 362/102 |
| 2,245,349 | 6/1941 | Lombardi | 362/102 |
| 2,785,289 | 3/1957 | Seiss | 362/202 |
| 2,810,822 | 10/1957 | Hauser | 362/202 |
| 3,004,140 | 10/1961 | Gomes | 362/32 |
| 3,074,196 | 1/1963 | Bronson, Sr. | 362/102 |
| 4,106,079 | 8/1978 | Drury | 362/34 |
| 4,858,083 | 8/1989 | Wakimoto | 362/101 |
| 4,924,358 | 5/1990 | Van Heck | 362/32 |
| 4,967,321 | 10/1990 | Cimock | 362/101 |
| 4,974,136 | 11/1990 | Noori-Shad et al. | 362/293 |

*Primary Examiner*—Ira S. Lazarus
*Assistant Examiner*—Leonard Heyman
*Attorney, Agent, or Firm*—Kane, Dalsimer, Sullivan, Kurucz, Levy, Eisele and Richard

[57] ABSTRACT

A decorative illuminating torch that, by reflecting and refracting light emitted to the side and rear of a light source through transparent thread members and down the length of a grip portion, the grip portion is illuminated. The light emitted from the front of the light source can be used to illuminate further novelty items.

19 Claims, 4 Drawing Sheets

DECORATIVE TORCH WITH ILLUMINATED GRIP PORTION

BACKGROUND OF THE INVENTION

The present invention relates to a decorative torch capable of illuminating its handle part in a twinkling way in the dark as if stars are shining, and producing a striking effect in a ceremony or the like.

A flash light or an electric lamp is used to light darkness by activating a lamp installed therein. This conventional light is usually used in a case of walking in the night or as a preparation for power failure, since it has limited function.

As a decorative torch having further functions more than the conventional light, a color changeable photo-decorative pencil torch as described in U.S. Pat. No. 4,858,083 is already known. This color changeable photo-decorative pencil torch comprises a transparent hollow body disposed in the front portion of an illuminating source. The transparent hollow body contains a liquid and a plurality of small pieces such as aluminum foil contained therein. Therefore, when the small pieces are lit by the illuminating source, these pieces reflects the light as if stars are shining in the hollow body.

Thus, according to the color changeable decorative torch, it can produce a decorative effect different from the conventional electric light. However, this effect is obtained by utilizing light radiated forwardly from the lamp, and will therefore produce this effect in front of the lamp. The light is radiated from the lamp not only in forward direction but also in side directions, therefore, there is the possibility to improve efficiency by utilizing the side or backward light.

An object of the present invention is, therefore, to present a decorative torch capable of utilizing not only forward light from the lamp, but backward or side light from the lamp for lighting the handle located at rearward direction of the lamp so that it can produce a highly decorative effect.

SUMMARY OF THE INVENTION

The present invention has been made to accomplish the object mentioned above, and is directed to a decorative torch comprising:

- a grip portion having a transparent hollow body, said grip portion having an axis;
- an illuminating light source located at one end of said grip portion;
- a refracting portion arranged in the vicinity of said illuminating light source for refracting light from the side portion of said illuminating light source in the axial direction of said grip portion to the opposite end thereof;
- a reflecting portion formed on said grip portion for reflecting light from said refracting portion in the radial external direction of said grip portion.

According to the present invention, a part of the light radiated from the illuminating source is refracted by the refracting portion, further guided to another end of the grip. This light will be further reflected by the reflecting portion formed on an inner surface of the grip so as to shine on substantially the whole grip and thereby twinkle.

On the other hand, light radiated from the other portion of the illuminating source will go through the opening to light the portions in front of the lamp.

DESCRIPTION OF THE PREFERRED EMBODIMENTS

The preferred embodiment of the present invention will be described below referring to FIGS. 1 to 10.

In the following description, wording as to indicate the vertical direction is in accordance with the direction shown in these figures.

Figure 1:
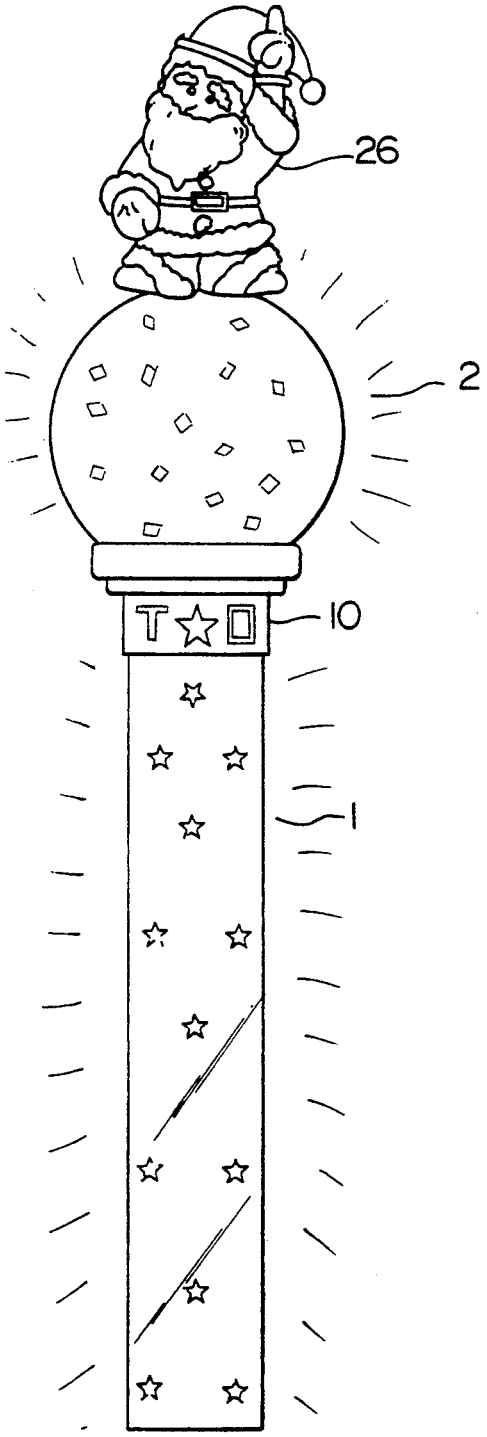
FIG. 1 is an elevational view of a decorative torch of the first embodiment according to the present invention.

FIG. 1 illustrates a first embodiment of a decorative torch of the present invention and reference numeral 1 designates a grip of a decorative torch to be gripped by a person, reference numeral 2 designates a decorative portion detatchably mounted on the upper portion of the grip 1.

The grip 1 and decorative portion 2 will be described below referring to a partial cross-sectional view of FIG. 2. The grip 1 is cylindrically formed from transparent plastic material, which includes a battery case 5 for storing battery cells 4 arranged in series therein.

A holding member 7 for holding an electric lamp 6 is fixed inside of the upper portion of the grip 1. This holding member 7 is formed from transparent material like plastics in a cylindrical shape as shown in a partial enlarged view FIG. 3. Threading portions 8, 9 are formed on an outer surface of the holding member 7 and inner surface of the grip 1 for threading them to each other. A tape 10 is wrapped around the upper portion of the grip 1, the inner surface of which is formed to have a mirror surface, for example, by laminating a metal sheet thereto. The threaded portions 8, 9 not only securely connect the holding member 7 to the grip 1, also form a refracting portion for refracting the light of the lamp 6 radiated from its side portion 6A, and leading them to the inner and lower portion of the grip 1. This will be explained below referring to FIG. 4, a partial enlarged view of a vicinity of the threaded portion 8, 9. These threaded portions 8, 9 are formed to have trapezoidal cross sections comprising inclined surfaces respective to the axis of the grip 1 as shown in FIG. 4. The light from the side portion 6A of the lamp 6 pass through the holding member 7 as shown by a mark X in FIG. 4, and then they are radiated into random directions through refraction at the threaded portions. The light are further reflected by a mirror surface 10A inside of a tape 10 wrapped around the upper portion of the grip 1, and pass through the inside of the grip 1 downwardly as is shown by a mark Y in FIG. 4.

On the inner surface of the grip 1, many recesses 11 are formed in a shape of an asterisk so as to reflect the downward light Y into random directions. Thus, the recesses 11 reflect the downward light Y as shown by a mark Z in FIG. 4 so as to brighten the grip partially or as a whole as if shining stars are scattered in the grip 1.

The recesses 11 are formed in a shape of an asterisk, but are not restricted to this shape, and may be formed in any shape such as a special pattern like a flower. A series of letters are also available including the name of the company in a case of advertisement or use for a commemoration gift for the company. An interesting way of use is obtained by forming recesses in a pattern of a map as will be described later referring to FIG. 8 to 11.

The tape 10 wrapped around the upper portion of the grip renders the light from the holding member 7 not to pass out of the grip 1 by a mirror surface on its inner surface as described above. This tape is replaceable with a cylindrically-shaped member fitted to the grip 1.

Since the battery case 5 is installed inside the transparent grip 1, it can be seen from the outside. Therefore, by coloring it in a various pattern and colors, a more decorative effect can be obtained. It is also useful to provide the battery case with a slide switch 5A, which can be handled by a finger in order to provide a lamp 6 with a current from the battery cells.

Figure 3:
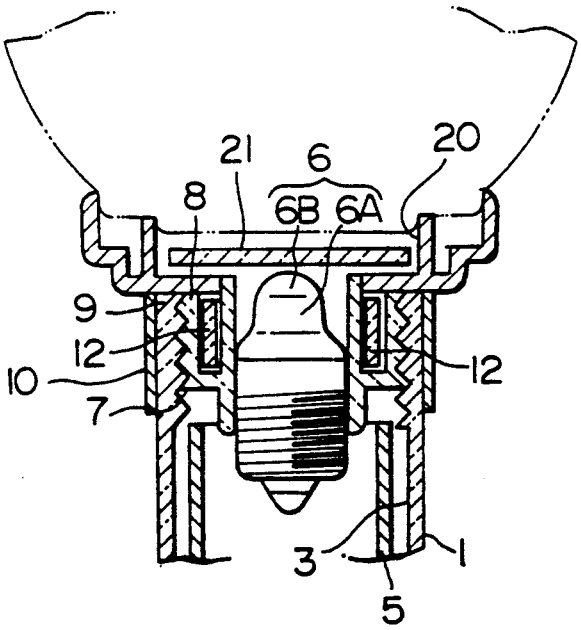
FIG. 3 is an enlarged sectional view showing a vicinity of the lamp of FIG. 2.
Figure 4:
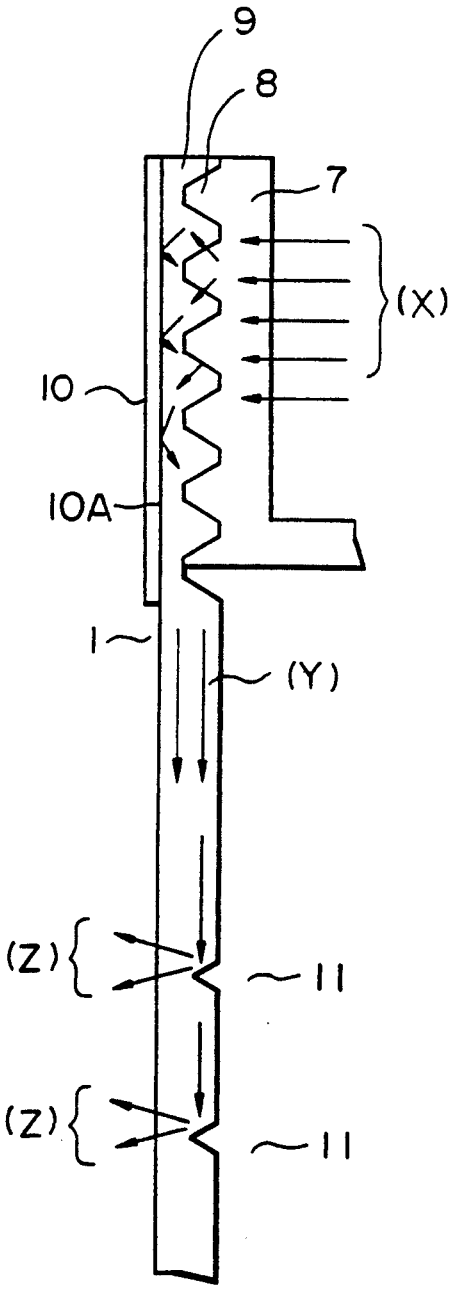
FIG. 4 is a schematic view showing reflections of light in the threaded portions, the tape or the recesses.
Figure 5:
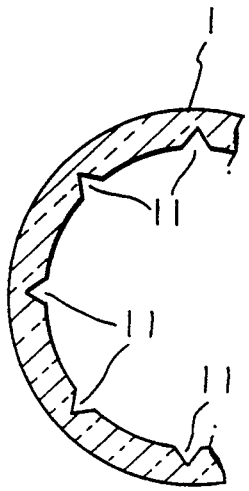
FIG. 5 is a cross-sectional view along the line V-V of FIG. 2 showing recesses.
Figure 7:
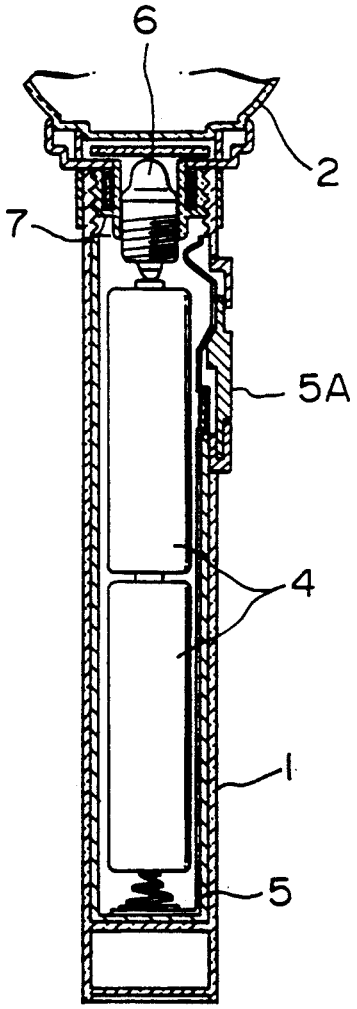
FIG. 7 is a partial cross-sectional view showing a vicinity of a switch of a battery case of the decorative torch.
Figure 6:
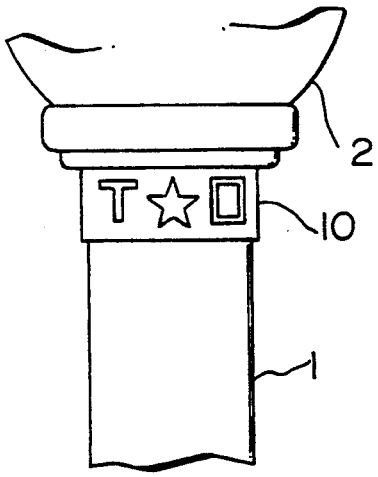
FIG. 6 is a partial view of the decorative torch showing a vicinity of the tape.

As shown in FIG. 3, a hollow space of a cylindrical shape is formed in the holding member 7, and a transparent coloring member 12 is arranged therein. This coloring member 12 is formed from a transparent material like plastics for coloring the light from the upper portion 6A of the lamp 6 while it passes therethrough. The coloring member 12 is formed smaller in size than the hollow space so that it is slidable along the circumferential direction. This coloring member 12 can be designed to have different colors along the circumferential direction so that different colors will appear at different portions of the grip 1 so that it can enhance the beauty of the light. Therefore, by shaking a decorative torch so as to move the coloring member 12 in rotational manner in the hollow space inside the holding member 7, the colors of the grip will change.

By changing the tightening torque between the threaded portions 8, 9, intensity of light transmitted therethrough is controlled, that is, the more torque is loaded between the threaded portion 8 and 9, the more light is transmitted from the holding member 7 to the grip 1. Therefore, the brightness of the grip 1 can be changed into an appropriate determined value by controlling the tightening torque.

The structure of the top portion of the grip 1 will be described below referring to FIGS. 2 and 3.

An opening 20 is formed at the upper portion of the holding member 7 for holding the lamp 6, and a transparent coloring plate 21 formed in a round plate is arranged therein for coloring the light from the upper portion 6B of the lamp 6 while they pass therethrough. This coloring plate 21 is held by a holder fixed around the opening 20 in a manner to permit the coloring plate 21 to rotate along the circumferential direction.

Above the holding member 7, a supporting member 22 is provided for detatchably supporting a decorative portion 2. Therefore, the coloring plate 21 is lit directly by the upward light which passed through the transparent coloring plate 21.

Figure 2:
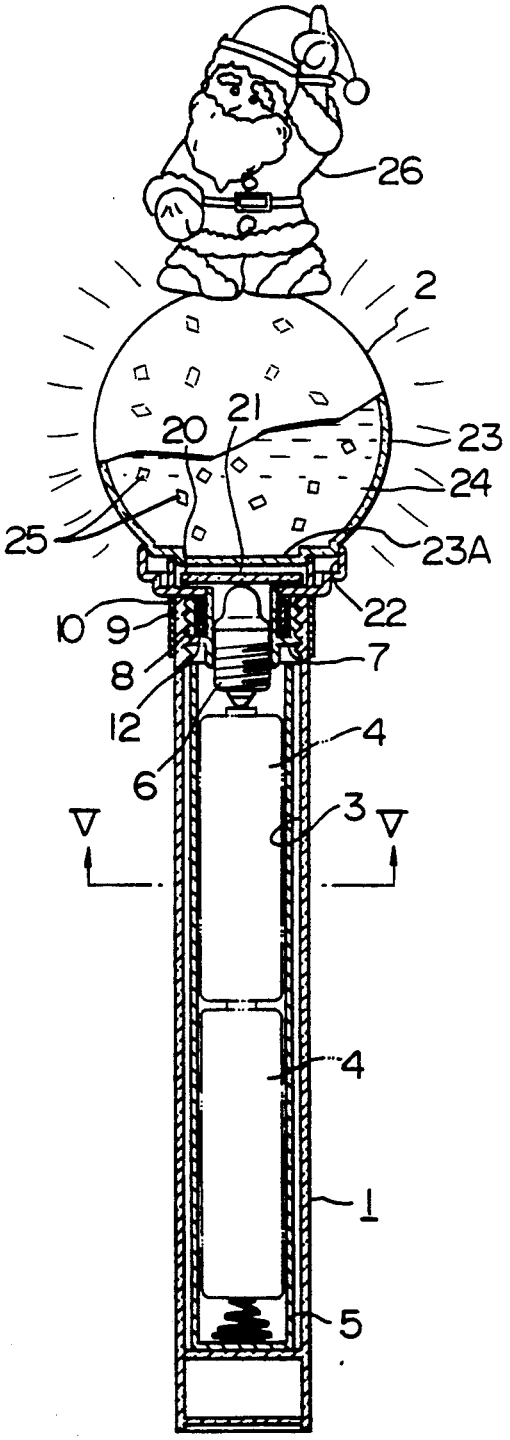
FIG. 2 is a partial cross-sectional view of FIG. 1.

The decorative portion 2, formed from a transparent material like plastics into a shape as shown in FIG. 2, comprises a ball body 23, scattering liquid 24 held in the hollow portion in the ball body 23 and a plurality of small pieces 25 dispersed in the scattering liquid 24. As light scattering liquid, an organic solvent, preferably the one, the specific gravity of which is greater than that of water, e.g., trichloroethylene, carbon tetrachloride, chloroform, water or a homogeneous mixture thereof might be used. And at the top of the decorative portion, a doll 26 is positioned.

After passing through the coloring plate 21, the light from the upper portion 6B of the lamp 6 passes through a flat plate 23A at the bottom of the ball body 23 and reflects off the small pieces 25 drifting among the scattering liquid 24 inside the ball body. The light, after entering inside of the ball body 23, will again pass through the ball body 23 to go out of the ball body 23 to illuminate the doll 26 on the ball body 23.

The coloring plate 21 is formed in a round plate shape, therefore, by coloring the coloring plate 21 differently along its circumferential direction, the decorative portion 2 will be lit in various colors so that it can enhance the beauty of the decorative portion 2. Further, in that case, by shaking the decorative torch to rotate the transparent coloring plate 21, the colors of the decorative portion 2 will also vary according to the rotation of the coloring plate 21.

According to the decorative torch above-explained, a lamp 6 is located at one end of the grip 1, and the light radiated from side portion 6A of the lamp 6 is refracted by a threaded portion 8, 9 and the inner surface of a tape 10, further guided to another end of the grip 1. The light will be further reflected by the recesses 11 formed on an inner surface of the grip 1, and accordingly the grip 1 shines as a whole in a twinkling way.

On the other hand, light radiated from upper portion 6B of the lamp 6 will go upward through the opening 20 to illuminate the decorative portion 2 in front of the lamp 6.

Therefore, light from the lamp 6 is separately guided not only to the decorative portion 2 but to the grip 1 so as to brighten the decorative torch as a whole and to create a highly decorative effect thereby.

OTHER EMBODIMENTS OF THE INVENTION

The other embodiments of the invention will be described referring to FIGS. 8 to 11 below.

Figure 8:
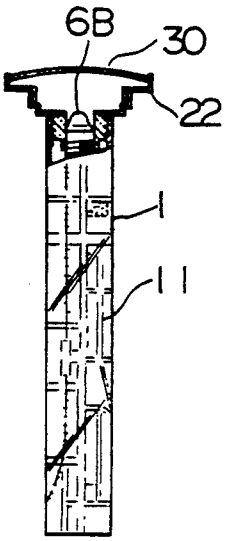
FIG. 8 is a partial cross-sectional view of the decorative torch of the second embodiment.

A decorative torch shown in FIG. 8 is provided with a lens 30 fitted to the holding member 22 for illuminating forward portion directly with light from the upper portion 6B of the lamp 6. Light from the side portion 6A is guided to the grip 1 to be refracted by the recesses 11 in the same way as the first embodiment. Therefore, by forming the recesses 11 in a pattern of a map, for instance, showing the way to an emergency exit or a shelter, it is very convenient for a person to escape in a emergency such as fire, earthquake or the like.

Figure 9:
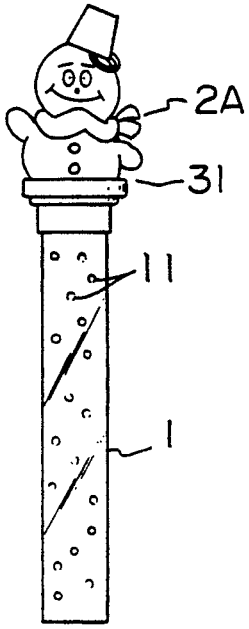
FIG. 9 is an elevational view of the decorative torch of the third embodiment.

Another embodiment is shown in FIG. 9, in which a decorative portion 2A is formed in a shape of a doll so that the doll can be illuminated directly by the light from the upper portion 6B of the lamp 6.

Figure 10:
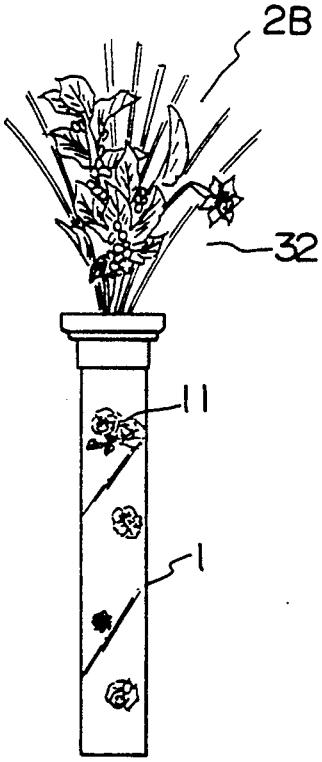
FIG. 10 is an elevational view of the fourth embodiment.

Another embodiment is shown in FIG. 10, in which a decorative portion 2A is formed in a shape of arranged flowers 32.

In these embodiments, it is desirable to form the recesses 11 in a shape of patterns relevant to the decorative portion, for example, a snow flake pattern for a snowman, a flower pattern for a flower arrangement so that it can emphasize the main characteristics of the decorative portion.

Figure 11:
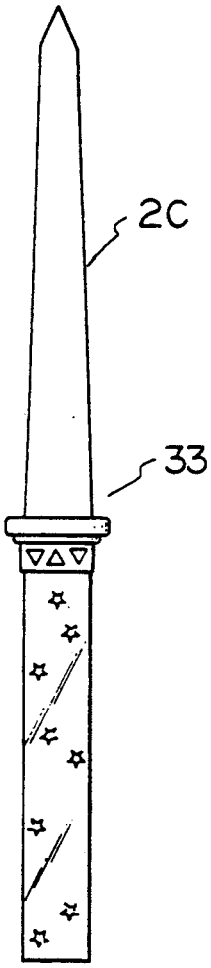
FIG. 11 is an elevational view of the fifth embodiment.

Another embodiment is shown in FIG. 11, in which a decorative portion 2C is formed in a shape of a sword that can be lit by the upper portion 6B.

What is claimed is:

1. A decorative torch comprising:

a grip portion having a transparent hollow body for receiving an opaque object therein, said grip portion having an axis;

an illuminating light source located at a first end of said grip portion;

a refracting portion arranged in the vicinity of a threaded portion formed on an inner surface of said transparent hollow body adjacent said illuminating light source, said threaded portion having an inclined surface relative to said axis of said grip portion for refracting light from a side portion of said illuminating light source in the axial direction of said grip portion to a second end thereof;

a reflecting portion formed on said grip portion for reflecting light from said refracting portion in a radial external direction of said grip portion.

2. A decorative torch according to claim 1, further including an opening arranged at said first end of said grip portion to allow light of said illuminating source to pass therethrough.

3. A decorative torch according to claim 1, wherein said illuminating light source includes an electric lamp and said opaque object includes a battery cell for powering said electric lamp.

4. A decorative torch according to claim 1, wherein said light reflecting portion includes a recess formed on the surface of said transparent hollow body.

5. A decorative torch according to claim 4, further including a holding plate for securely holding said illuminating source, said holding plate being formed from a transparent material, and having a threaded portion threaded to said threaded portion of said transparent hollow body.

6. A decorative torch according to claim 1, further including a coloring member interposed between said refracting portion and said illuminating source for coloring light from said illuminating source.

7. A decorative torch comprising:

a grip portion having a transparent hollow body, said grip portion having an axis;

an illuminating light source located at a first end of said grip portion;

a refracting portion arranged in the vicinity of said illuminating light source for refracting light from a side portion of said illuminating light source in the axial direction of said grip portion to a second end thereof;

a reflecting portion formed on said grip portion for reflecting light from said refracting portion in a radial external direction of said grip portion;

an inclined surface formed as a threaded portion formed on an inner surface of said transparent hollow body;

a coloring member formed in a hollow cylindrical shape interposed between said refracting portion and said illuminating light source for coloring light from said illuminating light source.

8. A decorative torch according to claim 7, wherein said coloring member is arranged rotatable about said axis of said transparent hollow body.

9. A decorative torch according to claim 8, further including a holding plate for securely holding said illuminating source, said holding plate includes a groove extending along the circumferential direction for retaining said coloring member slidably therealong.

10. A decorative torch according to claim 1, further including a decorative portion located at said first end of said grip portion to shine by light of said illuminating source via said opening of said grip portion.

11. A decorative torch according to claim 10, wherein said decorative portion is formed as a liquid-sealed case including scattering liquid therein for scattering said light of said illuminating source.

12. A decorative torch according to claim 5, further including a coloring member interposed between said refracting portion and said illuminating source for coloring light from said illuminating source.

13. A decorative torch comprising:

a grip portion having a transparent hollow body, said grip portion having an axis;

an illuminating light source located at a first end of said grip portion;

a refracting portion arranged in the vicinity of said illuminating light source for refracting light from a side portion of said illuminating light source in the axial direction of said grip portion to a second end thereof;

a reflecting portion formed on said grip portion for reflecting light from said refracting portion in a radial external direction of said grip portion;

a holding plate for securely holding said illuminating light source, said holding plate being formed from a transparent material, and having a threaded portion threaded to said threaded portion of said transparent hollow body;

a coloring member formed in a hollow cylindrical shape interposed between said refracting portion and said illuminating light source for coloring light from said illuminating light source.

14. A decorative torch according to claim 13, wherein said coloring member is arranged rotatable about said axis of said transparent hollow body.

15. A decorative torch according to claim 14, wherein said holding plate includes a grove extending along the circumferential direction for retaining said coloring member slidably therealong.

16. A decorative torch according to claim 5, further including a decorative portion located at said one end of said grip portion to shine by light of said illuminating source via said opening of said grip portion.

17. A decorative torch according to claim 16, wherein said decorative portion is formed as a liquid-sealed case including scattering liquid therein for scattering said light of said illuminating source.

18. A decorative torch according to claim 1, further including a inner plate installed in said transparent hollow body.

19. A decorative torch according to claim 18, further including a battery case which includes said holding plate to retain a battery cell therein.

* * * * *